US006828940B2

(12) United States Patent
Mueller

(10) Patent No.: US 6,828,940 B2
(45) Date of Patent: Dec. 7, 2004

(54) COMMUNICATION DEVICE

(75) Inventor: Wolfgang Mueller, Backnang (DE)

(73) Assignee: Robert Bosch GmbH, Stuttgart (DE)

( * ) Notice: Subject to any disclaimer, the term of this patent is extended or adjusted under 35 U.S.C. 154(b) by 3 days.

(21) Appl. No.: 10/337,800

(22) Filed: Jan. 7, 2003

(65) Prior Publication Data

US 2003/0146877 A1 Aug. 7, 2003

(30) Foreign Application Priority Data

Feb. 1, 2002 (DE) ..... 102 04 138

(51) Int. Cl.[7] ..... H01Q 1/24
(52) U.S. Cl. ..... 343/702; 343/748
(58) Field of Search ..... 343/702, 718, 343/741, 866, 841, 872, 748, 720; 455/90

(56) References Cited

U.S. PATENT DOCUMENTS

| | | | | |
|---|---|---|---|---|
| 4,920,353 A | | 4/1990 | Mori et al. | 343/702 |
| 5,020,136 A | * | 5/1991 | Patsiokas et al. | 343/872 |
| 5,227,804 A | * | 7/1993 | Oda | 343/702 |
| 6,040,804 A | | 3/2000 | Harano | 343/702 |
| 6,104,920 A | | 8/2000 | Llewellyn et al. | 343/702 |

FOREIGN PATENT DOCUMENTS

| | | | |
|---|---|---|---|
| DE | 198 24 145 A1 | 12/1999 | H01Q/1/24 |
| EP | 0 339 628 A2 | 11/1989 | H01Q/1/24 |
| GB | 2 334 624 A | 8/1999 | H01Q/1/44 |
| JP | 61-123303 | 6/1986 | H01Q/1/44 |

* cited by examiner

*Primary Examiner*—Hoang V. Nguyen

(57) ABSTRACT

A communication device has at least one transmitter and/or receiver, an energy storage, and a signal coupling connecting the transmitter and/or receiver with the energy storage for transmitting and/or receiving a radio signal.

5 Claims, 1 Drawing Sheet

COMMUNICATION DEVICE

BACKGROUND OF THE INVENTION

The present invention relates to communication devices. More particularly, it relates to a communication device having a transmitter and/or a receiver.

Communication devices of this type are known in the art and used in many varieties. It is believed that the existing communication devices can be further improved.

SUMMARY OF THE INVENTION

Accordingly, it is an object of the present invention to provide a communication device which is a further improvement of the existing devices.

In keeping with these objects and with others which will become apparent herein after, one feature of the present invention resides, briefly stated, in a communication device which has at least one element selected from the group consisting of a transmitter, a receiver, and both; an energy storage; a signal coupling connecting said at least one element with said energy storage for transmitting and/or receiving a radio signal.

With the communication device it is designed in accordance with the present invention, it has an advantage in that no separate antenna is needed for reception or transmission of radio signals.

In the present invention, advantageously an available energy storage is utilized as an antenna. Thereby this available element is used to perform an additional function. For this purpose a signal coupling from the transmitter or the receiver to the energy storage is provided.

In particular for miniature applications, where space conditions do not provide a possibility for an optimal antenna guide, it is advantageous to use as the antenna mechanical conducting elements which lead away from the circuitry such as the battery or another energy storage. Naturally, several batteries or a whole battery pack can be utilized as well.

In accordance with the present invention it is especially advantageous when a first pole of the battery or the accumulator serves for a signal coupling. Therefore this first pole is connected for example to ground through an inductivity, so that this battery pole is placed with high frequency above ground. This is the case when the outer housing of the battery acts as the ground. Since an inductivity exhibits a higher resistance with an increasing frequency, therefore with high frequency signals which must be transmitted, almost a separation to ground is made available. The second pole, to the contrary, can be also connected through an inductivity. This depends on the presumptions of the actual design, such as for example the dimensions, the used frequency and the wave resistors.

It is further advantageous when the energy storage element itself is a magnetic loop antenna which is especially suitable for the compact construction. Such a magnetic loop has for example a variable condensor, for equalization of the loop antenna. Such an antenna has conventionally a higher quality factor and makes possible a selective reception or a selective transmission.

Moreover, its advantageous when in accordance with the present invention all elements of the communication device are accommodated in one housing composed, for example, of a synthetic plastic material, or in other words produced from a non-conductive material.

The inventive communication device advantageously can be utilized also as a short-circuiting device, for example as a door or an alarm contact, as a motion detector, as a fire detector, as a temperature detector or also in other areas in household and security technologies.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Antennas are known in many forms. Substantially a common features of all antennas is they can be excited to resonance with a frequency to be received or transmitted. There are mono-pole antennas, dipole antennas and frame antennas. The frame antennas are identified as loop antennas. They have there specific properties. These properties include in particular the direction property, or in other words in which direction antenna radiates electric energy and the wave resistance. Also, another feature which is common for all antennas is that the ambiance of the distance to ground plays a great role for its properties. For example it is not sufficient to take simply a lambda quarter rod. This rod at its feed point which is identified as a foot point, must be isolated and extend perpendicular to its conducting plane. The antenna properties of such a lambda quarter antenna worsen dramatically when it is guided not perpendicularly, but instead for example parallel and near its conducting plane.

In accordance with the present invention it is proposed for miniature applications such as for detectors, to utilize an available energy storage, such as a battery or an accumulator, as the antenna. For this purpose a signal coupling is provided from the transmitter or receiver to the energy storage. The transmitter or receiver is conventionally embodied in a high frequency circuit. Instead the HF signal is supplied to the foot point of the antenna as a signal to be transmitted to the battery which now acts as the antenna. This is carried out in a transmission operation. In a reception operation the HF signal is taken from the battery. Preferably, this is carried out on the battery pole, which represents the housing of the battery. In conventional alkali-manganese cells this is the minus pole. At least this battery pole is placed with high frequency above ground, or in other words for example with a small inductivity. The other pole can be placed with high frequency to the ground or also can be placed above ground. This depends on the presumptions for the design of the battery, such as for example dimensions, frequency or wave resistances. Furthermore, it is possible to use the battery as a part of a magnetic loop antenna.

Figure 1:
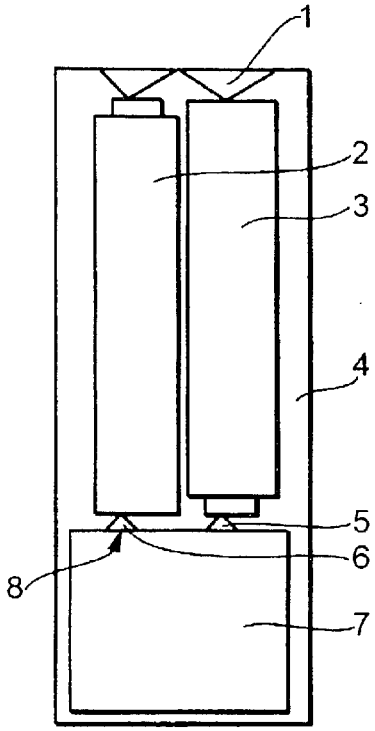
FIG. 1 is a view schematically showing a communication device in accordance with the present invention.

FIG. 1 schematically shows the construction of the inventive communication device. It has a housing 4 which accommodates a circuit 7 formed for transmission and/or reception, or in other words a high frequency circuit, and also accommodates batteries 2 and 3. The circuit 7 is connected with a pole 6 of the battery 2 through a signal coupling 8. This can be carried out through a battery contact 5. The oppositely located battery contact 1 connects both batteries 2 and 3 with one another. The housing 4 is composed of synthetic plastic, so that the batteries 1 and 2 can operate as antennas. An additional antenna outside of the housing 4 is not needed.

Figure 2:
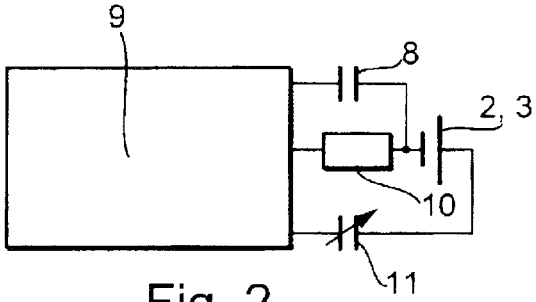
FIG. 2 is a view showing a first block diagram of the inventive communication device.

FIG. 2 shows a first block diagram of the design of the inventive communication device. The circuit 9 is connected with the batteries 2 and 3 through a condenser 8 which acts a signal coupling. An inductivity 10 is arranged parallel to the condensor 8 and connects the batteries 2, 3 with the ground. Thereby a high frequency placement of the battery above ground is provided. The inductivity 10 can be designed with electrical values so that the inductivity 10 is a component of the antenna. On the other side, the batteries 2, 3 are connected with a variable condenser 11 which also at its another side is connected with the circuit 9.

FIG. 2 shows the design of a magnetic loop with a variation of the condenser 11 for tuning of the antenna, composed of the batteries 2, 3, and the condensor 11. The battery 2, 3 is therefore a part of the magnetic loop antenna, and the mechanical length of the battery forms the inductivity for the oscillation circuit. Instead of a variable condensor, also a condensor with a fixed capacity can be utilized. A variable condenser is desirable for a magnetic loop antenna, since it has a very small band and is very selective.

Figure 3:
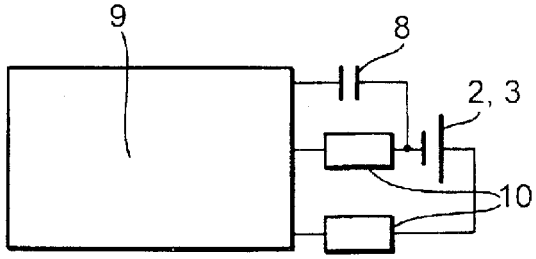
FIG. 3 is a view showing a second block diagram of the inventive communication device.

FIG. 3 shows a second block diagram of the inventive communication device. The circuit 9 is connected with a battery 2, 3, through the condenser 8. An inductivity 10 is connected to the battery 2, 3, parallel to the condenser 8. Another inductivity 10 is connected also to the other side of the battery 2, 3, or in other words to the other pole. Thereby the battery 2, 3 at both sides is placed through the inductivity 10 with high frequency above the ground.

Figure 4:
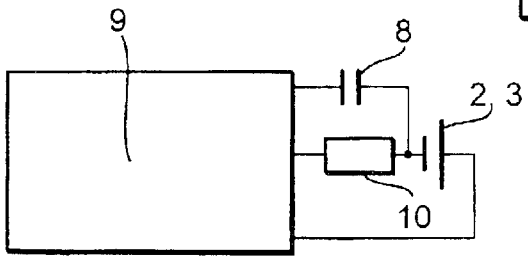
FIG. 4 is a third view of the communication device as a block diagram.

FIG. 4 shows a third block diagram of the inventive communication device. The circuit 9 is connected through the condenser 8 with the battery 2, 3 while the inductivity again parallel to the condenser 8 places the first pole of the battery 2, 3 with high frequency above the ground. The other pole of the battery 2, 3 is connected by a conductor with ground which is available on the circuit 9. Here a direct connection to ground is obtained.

It will be understood that each of the elements described above, or two or more together, may also find a useful application in other types of constructions differing from the types described above.

While the invention has been illustrated and described as embodied in a communication device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A communication device, comprising at least one element selected from the group consisting of a transmitter, a receiver, and both; an energy storage; a signal coupling connecting said at least one element with said energy storage for transmitting and/or receiving a radio signal, wherein said energy storage is formed as a member selected from the group consisting of a battery and an accumulator, wherein said battery or accumulator has a first pole for said signal coupling, and wherein said first pole is connected via an inductivity.

2. A communication device as defined in claim 1; and further comprising a housing which accommodates said energy storage and said at least one element.

3. A communication device comprising at least one element selected from the group consisting of a transmitter, a receiver, and both; an energy storage; a signal coupling connecting said at least one element with said energy storage for transmitting and/or receiving a radio signal, wherein said energy storage is formed as a member selected from the group consisting of a battery and an accumulator, wherein said battery or accumulator has a first pole for said signal coupling, and wherein said battery or said accumulator has a second pole which is connected to ground.

4. A detector, comprising a communication device including at least on element selected from the group consisting of a transmitter, a receiver, and both; an energy storage; a signal coupling connecting said at least one element with said energy storage for transmitting and/or receiving a radio signal, wherein said energy storage is formed as a member selected from the group consisting of a battery and an accumulator, wherein said battery or accumulator has a first pole for said signal coupling, and wherein said first pole is connected via an inductivity.

5. A communication device, comprising at least one element selected from the group consisting of a transmitter, a receiver, and both; an energy storage; a signal coupling connecting said at least one element with said energy storage for transmitting and/or receiving a radio signal, said energy storage having first and second poles, wherein the energy storage is an element of a magnetic loop antenna, and wherein the magnetic loop antenna is formed by both the first and second poles of the energy storage.

* * * * *